US008682021B2

(12) United States Patent
Kosuda et al.

(10) Patent No.: US 8,682,021 B2
(45) Date of Patent: Mar. 25, 2014

(54) SPEAKER UNIT AND PORTABLE INFORMATION TERMINAL

(75) Inventors: Kazuyuki Kosuda, Neyagawa (JP); Yuki Hatanaka, Nishinomiya (JP)

(73) Assignee: SANYO Electric Co., Ltd., Moriguchi-shi, Osaka (JP)

( * ) Notice: Subject to any disclaimer, the term of this patent is extended or adjusted under 35 U.S.C. 154(b) by 2 days.

(21) Appl. No.: 13/148,573

(22) PCT Filed: Feb. 3, 2010

(86) PCT No.: PCT/JP2010/051470

§ 371 (c)(1), (2), (4) Date: Aug. 9, 2011

(87) PCT Pub. No.: WO2010/090201

PCT Pub. Date: Aug. 12, 2010

(65) Prior Publication Data

US 2011/0311092 A1 Dec. 22, 2011

(30) Foreign Application Priority Data

Feb. 9, 2009 (JP) ..... 2009-027230

(51) Int. Cl.
*H04R 25/00* (2006.01)

(52) U.S. Cl.
USPC ..... 381/398; 381/431

(58) Field of Classification Search
USPC ..... 381/396, 398, 399, 408, 421, 422, 431
See application file for complete search history.

(56) References Cited

U.S. PATENT DOCUMENTS 6,038,327 A * 3/2000 Bleim et al. ..... 381/344
7,054,459 B2 * 5/2006 Kuze et al. ..... 381/398

(Continued)

FOREIGN PATENT DOCUMENTS

JP 59-169189 U 11/1984
JP 61-121097 U 7/1986

(Continued)

OTHER PUBLICATIONS

International Search Report for PCT/JP2010/051470, mailing date of Apr. 27, 2010.
Chinese Office Action dated Jun. 13, 2013, issued in corresponding Chinese Patent Application No. 201080006727.0, w/English translation.

*Primary Examiner* — Mohammad Islam
*Assistant Examiner* — Phylesha Dabney
(74) *Attorney, Agent, or Firm* — Westerman, Hattori, Daniels & Adrian, LLP

(57) ABSTRACT

A speaker unit adaptable to limited mounting space, allowing reduction in the lowest resonance frequency, and realizing higher sound pressure and smaller distortion is provided. A diaphragm includes a trunk portion 43 to which a coil 5 is attached, and an edge portion 42 surrounding an outer circumference 43*a* of trunk portion 43 in plan view. A reinforcement sheet is attached to the trunk portion. An outer circumference 42*a* of edge portion 42 includes first and second edge straight sections LE1 and LE2, and an edge curve section CE. Each of the first and second edge straight sections LE1 and LE2 extend in the major axis direction and minor axis direction of edge portion 42. An edge curve section CE joins the first and second edge straight sections LE1 and LE2 together. Each of trunk portion 43 of the diaphragm and reinforcement sheet is transparent to light having a wavelength in the visible light region.

6 Claims, 6 Drawing Sheets

(56) References Cited

U.S. PATENT DOCUMENTS

| | | | | |
|---|---|---|---|---|
| 7,397,927 | B2 * | 7/2008 | Pircaro et al. | 381/398 |
| 7,801,324 | B2 * | 9/2010 | Kimura et al. | 381/430 |
| 8,094,864 | B2 * | 1/2012 | Inaba et al. | 381/398 |
| 8,139,812 | B2 * | 3/2012 | Basnet et al. | 381/398 |
| 2003/0112995 | A1 * | 6/2003 | Frasl | 381/398 |
| 2007/0098207 | A1 * | 5/2007 | Lin | 381/399 |
| 2009/0052726 | A1 * | 2/2009 | Hatanaka | 381/431 |
| 2011/0194724 | A1 * | 8/2011 | Watanabe et al. | 381/398 |

FOREIGN PATENT DOCUMENTS

| | | | |
|---|---|---|---|
| JP | 2006-215510 | A | 6/2006 |
| JP | 2006-215510 | A | 8/2006 |
| JP | 2006-229657 | A | 8/2006 |
| JP | 2008-545314 | A | 12/2008 |
| WO | 2006/082754 | A1 | 8/2006 |
| WO | 2006/126149 | A1 | 11/2006 |

* cited by examiner

SPEAKER UNIT AND PORTABLE INFORMATION TERMINAL

TECHNICAL FIELD

The present invention relates to speaker units and portable information terminals. Particularly, the present invention relates to a speaker unit including a diaphragm having a coil attached, and a portable information terminal incorporating the speaker unit.

BACKGROUND ART

In recent years, development is seen in reducing the size, thickness, and weight of a portable information terminal such as a mobile phone, DSC (Digital Still Camera), PDA (Personal Digital Assistants), PC (Personal Computer), and the like. Therefore, a speaker unit for such a portable information terminal will be mounted in a limited space, requiring a shape corresponding to the space. Accordingly, the shape of the diaphragm employed in the speaker unit will be restricted. For example, WO 2006/082754 teaches a diaphragm of a non-circular shape having a different major axis and minor axis.

CITATION LIST

Patent Literature

PTL 1: WO 2006/082754

SUMMARY OF INVENTION

Technical Problem

While the shape of a diaphragm is limited as mentioned above, improvement in the performance of the speaker unit is required. Particularly, reduction in the lowest resonance frequency (Fo), higher sound pressure, and smaller distortion are required.

One possible method to reduce the lowest resonance frequency is to make the diaphragm thinner to facilitate vibration. However, simply reducing the thickness of the diaphragm will readily disturb the coil vibration due to the occurrence of torsional vibration at the diaphragm. As a result, the coil will not vibrate properly corresponding to the input signal, causing a larger distortion component in the output sound and/or becoming difficult to obtain effective sound pressure. In other words, there is a problem that it will become difficult to achieve smaller distortion and higher sound pressure.

In view of the foregoing, an object of the present invention is to provide a speaker unit adaptable to limited mounting space, allowing reduction in the lowest resonance frequency, and realizing higher sound pressure and smaller distortion.

Another object of the present invention is to provide a portable information terminal reduced in size, thickness, or weight.

Solution to Problem

A speaker unit of the present invention includes a coil, a diaphragm, and a reinforcement sheet. The diaphragm includes a trunk portion to which the coil is attached, and an edge portion surrounding the outer circumference of the trunk portion in plan view. The reinforcement sheet is attached to the trunk portion. The outer circumference of the edge portion includes first and second edge straight sections, and an edge curve section. Each of the first and second edge straight sections extends linearly in the major axis direction and minor axis direction of the edge section. The edge curve section joins the first and second edge straight sections together. Each of the trunk portion of the diaphragm and the reinforcement sheet is transparent with respect to light having a wavelength in the visible light region.

According to a speaker unit of the present invention, the dimension in the minor axis direction can be set smaller than the dimension in the major axis direction. By aligning the minor axis direction to coincide with the direction corresponding to the smaller dimension in the mounting space, the speaker unit can be mounted utilizing the limited mounting space more effectively.

Further, since the rigidity of the trunk portion is increased by the reinforcement sheet, inclination of the coil attached to the trunk portion can be suppressed. Accordingly, disturbance in the coil vibration at the low frequency range can be suppressed, allowing reduction in the lowest resonance frequency.

The outer circumference of the edge portion includes a second edge straight section in the direction of the shorter side. Accordingly, distortion of the diaphragm that readily occurs in proportion to a larger curvature at the outer circumference of the edge portion can be suppressed. Thus, smaller distortion can be realized. In addition, higher sound pressure can be achieved since effective sound pressure can be achieved more readily.

The first edge straight section and the second edge straight section are joined by the edge curve section. Since the first edge straight section and the second edge straight section can be joined smoothly, a section where the curvature is locally increased at the outer circumference of the edge portion can be eliminated. Thus, distortion in the diaphragm readily occurring in proportion to a larger curvature at the circumference of the edge portion can be suppressed. Thus, smaller distortion can be realized. In addition, higher sound pressure can be achieved since effective sound pressure can be achieved more readily.

Since the trunk portion of the diaphragm and the reinforcement sheet each are transparent to light having a wavelength in the visible light region, incidence of visible light to the face of the trunk portion at the coil side is allowed via the trunk portion and. the reinforcement sheet. Accordingly, the coil and the trunk portion can be bonded more effectively using an adhesive of the visible light curing type. Thus, the fabrication cost of the speaker unit can be reduced.

Preferably, the reinforcement sheet is attached to the trunk portion by means of an adhesive that allows transmission of visible light. This prevents the light directed to curing the visible light curing type adhesive from being absorbed between the reinforcement sheet and the trunk portion.

Preferably, the edge curve section has a shape represented by either a quadratic or cubic curve. Accordingly, the maximum distance between the intersection point of the major axis and minor axis and the edge curve section can be reduced as compared to the case where an arc shape is employed. Thus, the balance in the vibration of the diaphragm can be prevented from being disturbed.

Preferably, the diaphragm includes a plurality of crimps in a region of the edge portion located between phantom straight lines extending from the center of the trunk portion to respective ends of the edge curve section. By virtue of the crimps, generation of distortion at the diaphragm in the proximity of the edge curve section can be suppressed. Therefore, smaller distortion and higher sound pressure can be realized.

Preferably, the plurality of crimps extends radially with respect to the center of the trunk portion. Accordingly, the crimps can be disposed with higher symmetry, so that the symmetry of the stress distribution at the diaphragm can be improved. Accordingly, inclination of the coil caused by the balance in the stress distribution of the diaphragm being disturbed can be suppressed.

Preferably, at least one of the plurality of crimps extends along a phantom straight line extending from the center of the trunk portion to an end of the first edge straight section. Accordingly, concentration of stress on the phantom line extending from the center of the trunk portion to an end of the first edge straight section can be suppressed.

Preferably, the diaphragm includes an outer frame portion surrounding the edge portion in plan view, and that is transparent to light having a wavelength in the visible light region. The speaker unit further includes a reinforcement ring attached on the outer frame portion, and that allows transmission of visible light. Accordingly, the outer frame portion and the reinforcement ring can be bonded more effectively using an adhesive of the visible light curing type.

Preferably, the reinforcement ring is attached to the outer frame portion by means of an adhesive that allows transmission of visible light. This can prevent the light directed to curing the visible light curing type adhesive from being absorbed between the outer frame portion and the reinforcement ring.

A portable information terminal of the present invention includes a speaker unit set forth above. Accordingly, the speaker unit can be mounted in a more limited space. Therefore, the portable information terminal can be reduced in size, thickness, or weight.

Advantageous Effects of Invention

The speaker unit of the present invention is adaptable to a restricted mounting space, and allows the lowest resonance frequency to be reduced, and higher sound pressure and smaller distortion to be realized.

According to a portable information terminal of the present invention, reduction in the size, thickness, or weight can be realized for a portable information terminal.

DESCRIPTION OF EMBODIMENTS

Embodiments of the present invention will be described hereinafter based on the drawings.

First Embodiment

Figure 1:
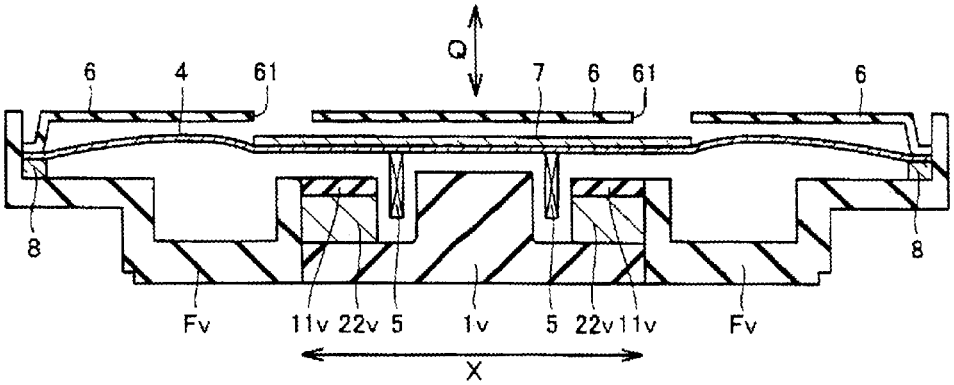
FIG. 1 is a schematic sectional view of a configuration of a speaker unit according to a first embodiment of the present invention.
Figure 2:
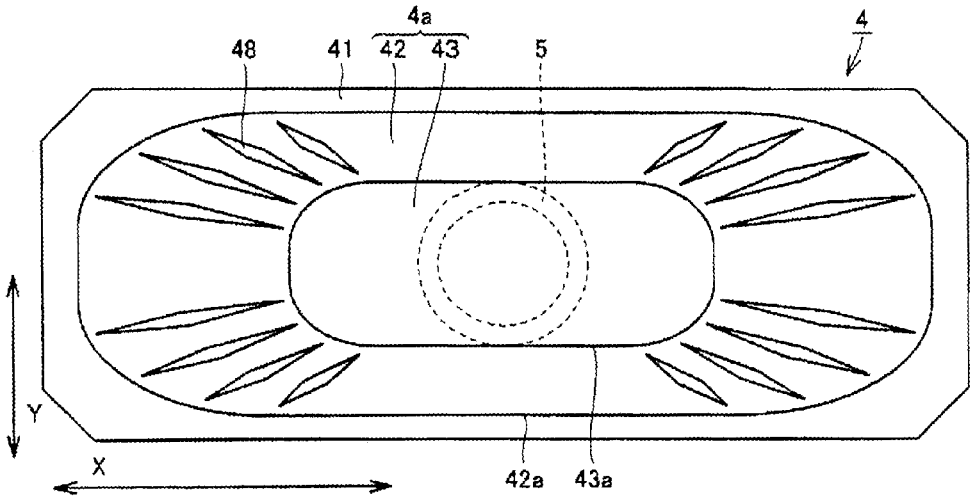
FIG. 2 is a schematic plan view of a configuration of a diaphragm of the speaker unit according to the first embodiment of the present invention.
Figure 3:
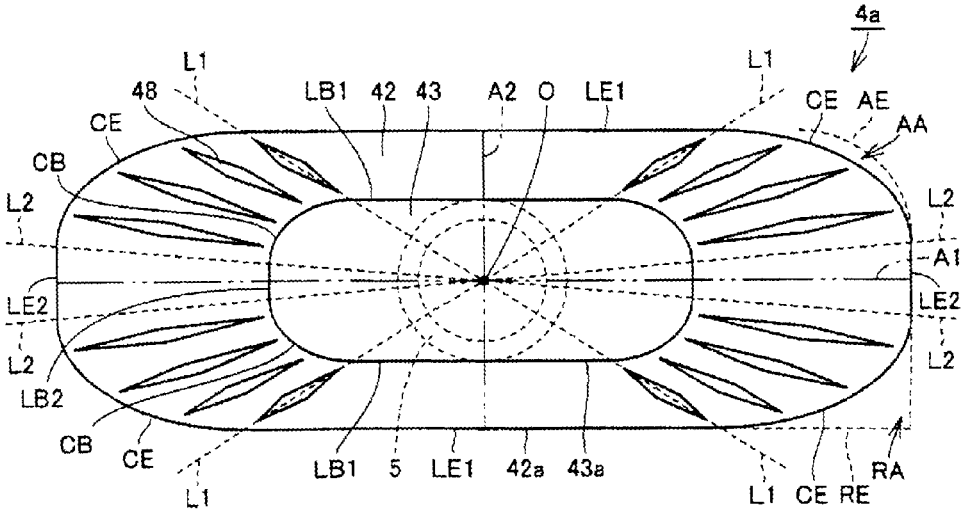
FIG. 3 is a schematic plan view of a configuration of an edge portion and a trunk portion according to the first embodiment of the present invention.
Figure 4:
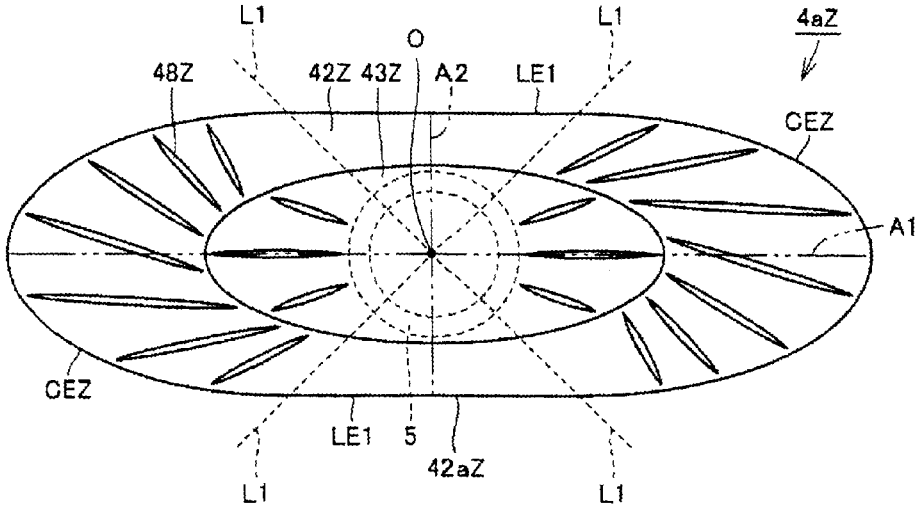
FIG. 4 is a schematic plan view of a configuration of an edge portion and a trunk portion of a speaker unit according to a comparative example.

Referring to FIGS. 1-3, a speaker unit according to the present embodiment includes a coil 5, a diaphragm 4, a reinforcement sheet 7, a reinforcement ring 8, a base frame Fv, a bottom plate 1*v*, an upper plate 11*v*, a magnet 22*v*, and a cover 6.

Diaphragm 4 is flexible, made of a PET (Polyethylene Terephthalate) film or PEI (Polyether Imide) film of 8-50 μm in thickness, for example. Diaphragm 4 includes a diaphragm piece 4*a* that is the region of displacement, and an outer frame portion 41 that is the fixed portion. Diaphragm piece 4*a* includes a trunk portion 43 and an edge portion 42.

Trunk portion 43 is formed flat, having a coil 5V attached at the bottom side in FIG. 1.

Edge portion 42 surrounds in plan view a trunk outer circumference 43*a* that is the outer circumference of trunk portion 43. Edge portion 42 is formed bending in the vibrating direction Q so as to support trunk portion 43 to allow vibration.

Outer frame portion 41 surrounds edge portion 42 in plan view. Outer frame portion 41 is formed flat, attached to the support face of frame Fv. Accordingly, outer frame portion 41 supports diaphragm piece 4*a* allowing vibration in the vibrating direction Q.

An edge outer circumference 42*a* that is the outer circumference of edge portion 42 includes, as shown in FIG. 3, first and second edge straight sections LE1 and LE2, and an edge curve section CE. Each of first and second edge straight sections LE1 and LE2 extends linearly in the major axis direction X and minor axis direction Y of edge portion 42. Edge curve section CE joins first and second edge straight sections LE1 and LE2 together. Edge curve section CE has a shape represented by either a quadratic curve or cubic curve, for example a shape represented by a parabola. Preferably, edge curve section CE does not include an arc shape.

Diaphragm piece 4*a* includes a plurality of crimps (tangential) 48 in edge portion 42. As shown in FIG. 3, crimps 48 are arranged at the outer side of the region located between a pair of first straight lines L1 connecting respective ends of first edge straight section LE1 with the intersection point O (center) of a major axis A1 and a minor axis A2, and at the outer side of the region located between a pair of second straight lines L2 connecting respective ends of second edge straight section LE2 with intersection point O. In other words, crimps 48 are arranged in the region of edge portion 42 located between first and second straight lines L1 and L2 (phantom straight lines) extending from intersection point O to each of the ends of edge curve section CE. Crimps 48 extend radially about intersection point O. At least one of crimps 48 extends along first straight line L1.

Reinforcement sheet 7 is attached to the top face of trunk portion 43 shown in FIG. 1. Each of reinforcement sheet 7 and trunk portion 43 is transparent to light having a wavelength in the visible light region, particularly light having the wavelength of 500-700 nm. The material of the reinforcement sheet includes PET, for example. Reinforcement sheet 7 is attached to trunk portion 43 by an adhesive that allows transmission of visible light such as acryl resin. Reinforcement sheet 7 has a thickness of, for example, 50-200

Reinforcement sheet 7 (FIG. 1) has a flat configuration identical to that of trunk portion 43. In other words, the outer circumference of reinforcement sheet 7 is identical to a trunk outer circumference 43*a* (FIG. 3) in plan view. Trunk outer circumference 43*a* includes first and second trunk straight sections LB1 and LB2, and a trunk curve section CB. Each of first and second trunk straight sections LB 1 and LB2 extends linearly in major axis direction X and minor axis direction Y. Trunk curve section CB joins first and second trunk straight sections LB1 and LB2 together. Trunk curve section CB has a shape represented by either a quadratic curve or cubic curve, for example a shape represented by a parabola. Preferably, trunk curve section CB does not include an arc shape.

Preferably, first trunk straight section LB1 extends so as to join the section between first straight lines L1 constituting a pair. Second trunk straight section LB2 extends so as to join the section between second straight lines Ln constituting a pair. Trunk curve section CB extends so as to join the section between first and second straight lines L1 and L2.

Reinforcement ring 8 serves to ease the handling of diaphragm 4 during the assembling process of the speaker unit. Each of reinforcement ring 8 and outer frame portion 41 is transparent to light having a wavelength in the visible light range, particularly light having a wavelength of 500-700 nm. Reinforcement ring 8 is attached to outer frame portion 41 by an adhesive that allows transmission of visible light.

Magnet 22*v* has an annular shape, and is provided at the bottom of base frame Fv to surround coil 5. Magnet 22*v* is arranged at the outer circumferential side of coil 5 spaced apart therefrom. In other words, the speaker unit of the present invention is an outer core type.

Frame Fv and bottom plate 1*v* (FIG. 1) constitute an elongated box-like shape.

Bottom plate 1*v* is formed of metal and has a cylindrical portion. Bottom plate 1*v* is attached to base frame Fv such that the cylindrical portion protrudes inward of coil 5.

Figure 5:
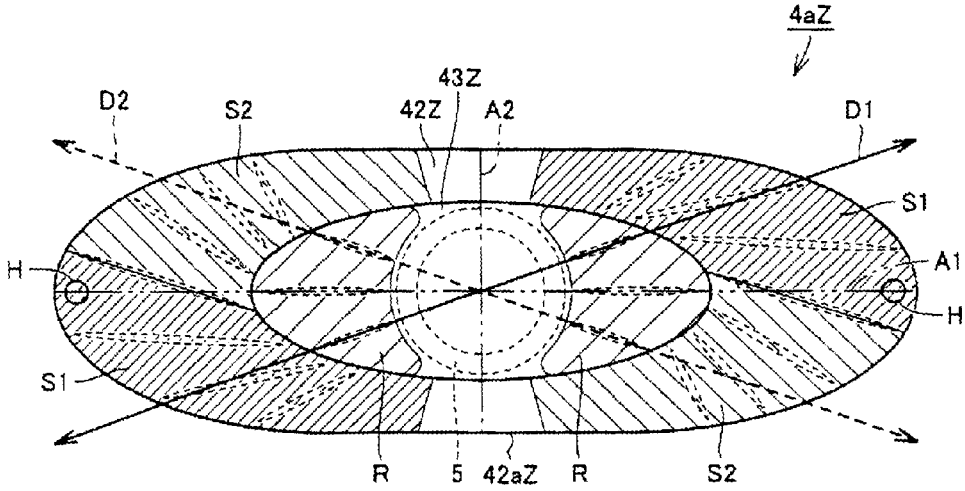
FIG. 5 is a schematic plan view of stress distribution corresponding to FIG. 4.
Figure 6:
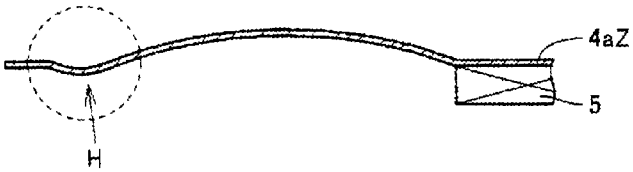
FIG. 6 is a schematic sectional view of a recess generated at the diaphragm of FIG. 5.

FIG. 5 is formed of a wire wound about an axis parallel to vibrating direction Q (FIG. 1), and has a cylindrical shape. A current flow to coil 5 causes diaphragm 4 to vibrate in the vibrating direction Q.

Cover 6 (FIG. 1) is arranged above diaphragm 4 with a space therebetween. Further, outer frame portion 41 of diaphragm 4 is located between cover 6 and the support face of frame Fv. Cover 6 has a sound out hole 61.

The functional effect of the speaker unit of the present embodiment will be described relative to a comparative example (FIGS. 4-7).

The provision of a second edge straight section LE2 (FIG. 3) according to the present embodiment allows the lowest resonance frequency to be reduced and achieves smaller distortion. This will be described relative to a comparative example.

Referring to a diaphragm piece 4*a*Z of a comparative example (FIG. 4), an edge outer circumference 42*a*Z of edge portion 42Z includes an edge curve section CEZ. Edge curve section CEZ has a shape corresponding to an ellipse cut into two along the minor axis, and joins first and second edge straight sections LE1 and LE2 together. At respective ends of major axis A1, edge outer circumference 42*a*Z has the aforementioned curvature of an ellipse. As a result of this curvature, torsion is generated such that a recess H (FIGS. 5 and 6) is formed at the site in proximity to either end of diaphragm piece 4*a*Z in the direction along major axis A1. The torsion facilitates the occurrence of distortion in the sound emitted from the speaker.

More specifically, a recess H may be formed by the residual stress generated at the time of shaping diaphragm piece 4*a*7 or the stress generated at the time of vibration. In such a case, the distance between diaphragm piece 4*a*7, and magnet 22*v* (FIG. 1) will become uneven, so that diaphragm piece 4*a*Z cannot be vibrated properly. Accordingly, the output sound is readily distorted in the vicinity of the lowest resonance frequency where the vibration amplitude of diaphragm piece 4*a*Z increases. Further, effective sound pressure cannot be achieved.

In contrast, the present embodiment can suppress formation of the aforementioned recess H by setting the curvature at the region of second straight section LE2 of edge outer circumference 42*a* to zero (FIG. 3). Accordingly, the lowest resonance frequency can be reduced. Further, higher sound pressure and smaller distortion can be realized.

Moreover, the provision of reinforcement sheet 7 (FIG. 1) in the present embodiment allows reduction in the lowest resonance frequency. This will be described contrastively relative to a comparison example.

Since reinforcement sheet 7 (FIG. 1) is not attached on trunk portion 43Z of diaphragm piece 4*a*Z (FIG. 4) in the comparative example, it will be difficult to ensure sufficient rigidity at trunk portion 43Z that supports coil 5. As a result, the vibrating posture of coil 5 (FIG. 7) is readily disturbed. Furthermore, if the rigidity of trunk portion 43Z is increased by applying an adhesive directed to attachment of coil 5 thick, the rigidity of trunk portion 43Z is readily varied due to variation in the application. The vibrating posture of coil 5 is also readily disturbed in such a case.

In contrast, the present embodiment has the rigidity of trunk portion 43 (FIG. 3) increased evenly by virtue of reinforcement sheet 7 (FIG. 1). Therefore, the vibrating posture of coil 5 is stabilized. Accordingly, coil 5 can vibrate in vibrating direction Q (FIG. 1) corresponding to the input signal. Therefore, higher sound pressure and low distortion can be realized.

Further, since each of reinforcement sheet 7 and trunk portion 43 is transparent to light having a wavelength in the visible light range, the incidence of visible light L (FIG. 8) upon the face of trunk portion 43 at coil 5 side is allowed via reinforcement sheet 7 and trunk portion 43. Accordingly, coil 5 and trunk portion 43 can be bonded effectively by means of a visible light curing type adhesive portion 85. Thus, the fabrication cost of a speaker unit can be reduced.

The provision of edge curve section CE (FIG. 3) of the present embodiment allows reduction in the lowest resonance frequency. Further, higher sound pressure and lower distortion can be realized. This will be described hereinafter.

If edge outer circumference 42*a* includes a right angle section (FIG. 3), the curvature at the corner of right angle section RE will be extremely great. Accordingly, a recess similar to recess H (FIGS. 5 and 6) is readily generated at a region RA at the proximity of the tip of right angle section RE.

In contrast, the present embodiment can suppress generation of a recess by employing an edge curve section CE having a curvature smaller than that of right angle section RE. Accordingly, the lowest resonance frequency can be reduced. Moreover, higher sound pressure and smaller distortion can be realized.

Since the area of diaphragm piece 4*a* can be increased by providing first edge straight section L1 (FIG. 3) in the present embodiment, higher sound pressure can be realized.

According to the present embodiment, edge curve section CE (FIG. 3) preferably does not include an arc. Accordingly, a region AA distant from intersection point O of diaphragm piece 4*a* can be eliminated, as compared to the case where an arc shape AE is employed. Therefore, deviation of the center of gravity of diaphragm piece 4*a* from intersection point O caused by an error in production can be suppressed. Thus, smaller distortion is realized since diaphragm piece 4*a* vibrates properly in the vibrating direction Q.

According to the present embodiment, higher sound pressure and smaller distortion can be realized by crimp 48 (FIG. 3). This will be described hereinafter relative to a comparison example.

A diaphragm piece 4*a*Z of a comparative example (FIG. 4) has a crimp 48Z provided even in the proximity of major axis A1. Vibration of edge portion 42Z in the proximity of major axis A1 is impeded by this crimp 48Z.

Therefore, the sound distortion component is readily increased, less likely to achieve effective sound pressure.

In contrast, crimp 48 is not provided in the region located between second straight lines L2 constituting a pair, each second straight line L2 connecting either end of second edge straight section LE2 with intersection point O in the present embodiment. Since the obstruction of vibration at edge portion 42 in proximity to major axis A1 caused by crimp 48 is suppressed, higher sound pressure and smaller distortion are realized.

Figure 7:
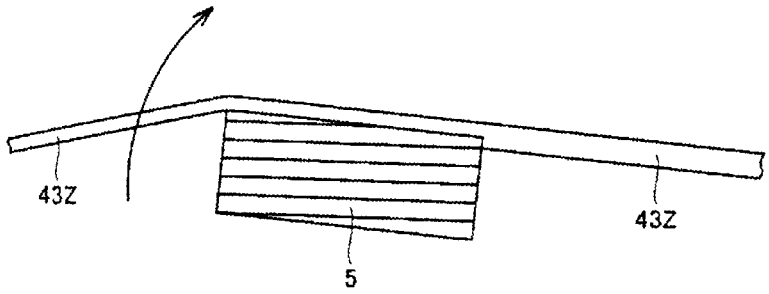
FIG. 7 is a front view representing an inclination of a coil in a comparative example.

Moreover, crimps 48Z in trunk portion 43Z (FIG. 4) of the comparative example are arranged non-symmetric to each of major axis A1 and minor axis A2. Therefore, as shown in FIG. 5, a region S1 where the stress is particularly great and a region S2 where the stress is moderate are distributed in a non-symmetric manner with respect to each of major axis A1 and minor axis A2. As a result, the application of the stress along diagonal direction D1 and the application of the stress along diagonal direction D2 in plan view of diaphragm piece 4*a*Z differ from each other. This difference induces the inclination of coil 5, as shown in FIG. 7.

In the present embodiment, a plurality of crimps 48 extend radially about intersection point O, as shown in FIG. 3. Since crimps 48 can be arranged with high symmetry, the symmetry of the stress distribution at diaphragm piece 4*a* can be increased. Accordingly, inclination of coil 5 caused by the balance of the stress distribution of diaphragm piece 4*a* being disturbed can be suppressed. Therefore, higher sound pressure and smaller distortion can be realized.

According to the present embodiment, at least one crimp 48 extends on and along first straight line L1, as shown in FIG. 3. Accordingly, higher sound pressure and smaller distortion can be realized. This will be described hereinafter relative to a modification of the present embodiment.

Figure 9:
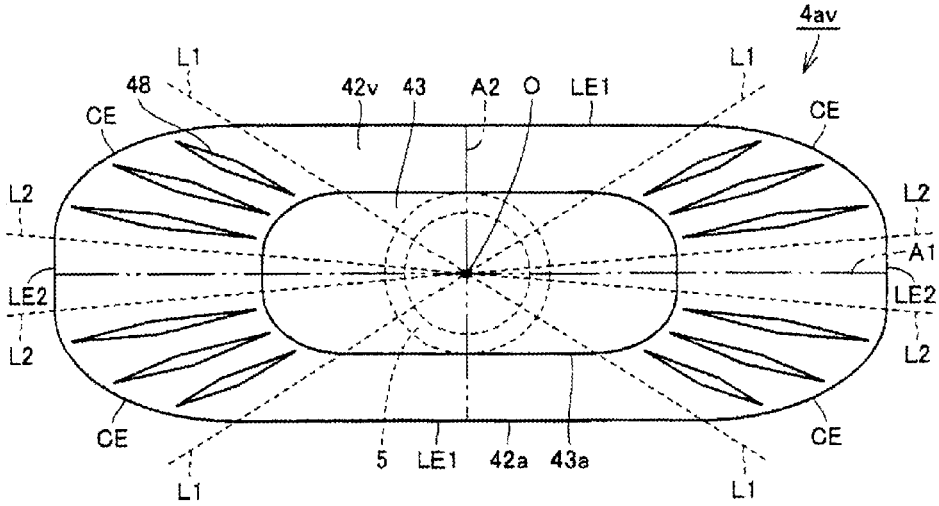
FIG. 9 is a schematic plan view of a configuration of an edge portion and a trunk portion in a modification of the first embodiment of the present invention.
Figure 10:
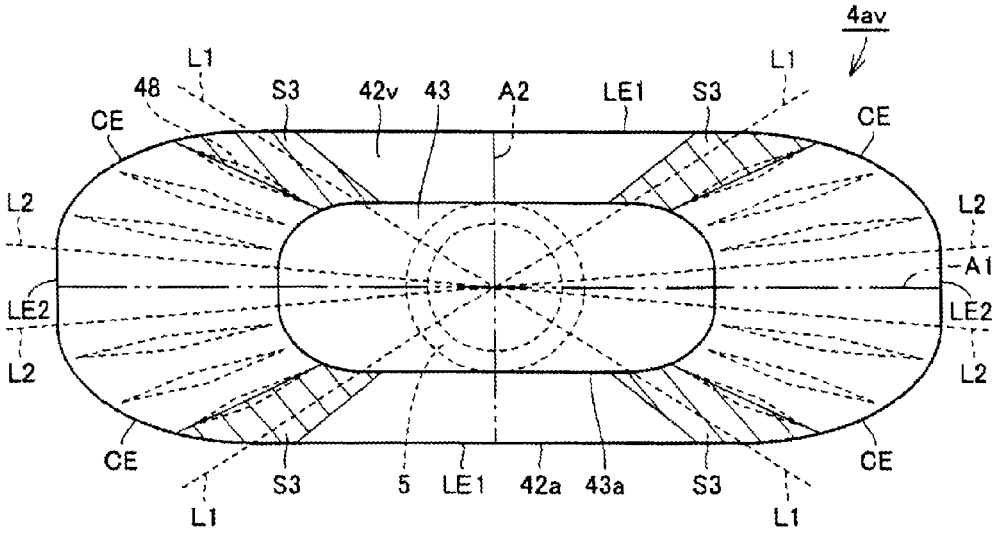
FIG. 10 is a schematic plan view of stress distribution corresponding to FIG. 9.

Diaphragm piece 4*av* (FIG. 9) of the modification differs from diaphragm piece 4*a* (FIG. 3) of the present embodiment in that crimp 48 is absent on first straight line L1. As a result, as shown in FIG. 10, a region S3 where stress is concentrated is generated in the proximity of straight line L1, although slighter than in regions S1 and S2 set forth above.

In contrast, the present embodiment has crimp 48 provided extending on and along first straight line L1, as shown in FIG. 3. Accordingly, the stress concentration at region S3 can be alleviated. Accordingly, higher sound pressure and smaller distortion can be realized.

Figure 8:
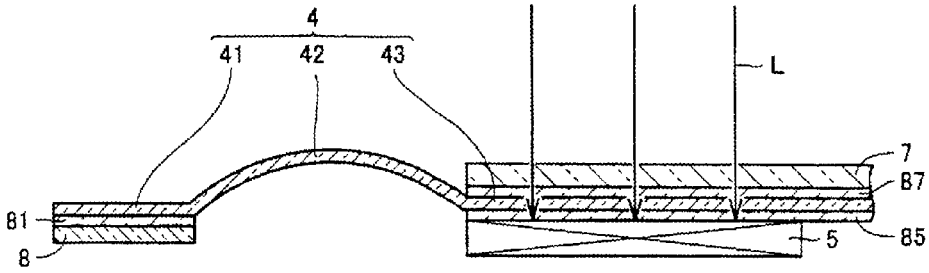
FIG. 8 is a schematic sectional view of the manner of a coil attached in a method of fabricating a speaker unit according to the first embodiment of the present invention.

According to the present embodiment, each of outer frame portion 41 and reinforcement ring 8 is transparent to light having a wavelength in the visible light range. Accordingly, outer frame portion 41 and reinforcement ring 8 can be bonded effectively using visible light curing type adhesive portion 81, as shown in FIG. 8. More preferably, adhesive portion 81 allows transmission of visible light. This suppresses the light directed to curing the visible light curing type adhesive from being absorbed between outer frame portion 41 and reinforcement ring 8.

Thus, as described above, the present embodiment allows reduction in the lowest resonance frequency. Furthermore, higher sound pressure and smaller distortion can be realized. The evaluation result will be described hereinafter.

Figure 11:
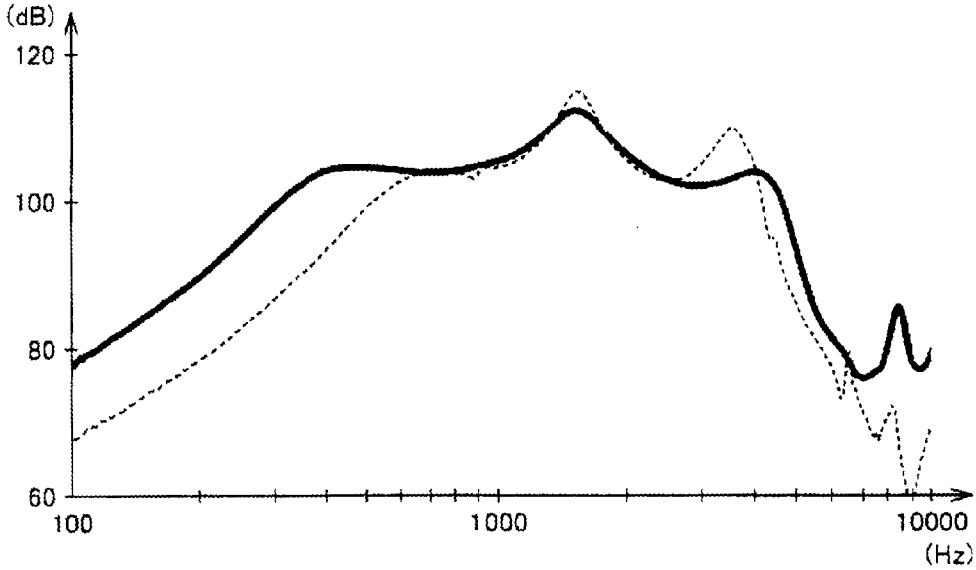
FIG. 11 is a graph schematically representing the frequency characteristic of the output from respective speaker units of the first embodiment of the present invention and a comparative example.

Referring to FIG. 11, the output from the speaker unit of the comparative example indicated by broken lines begin to become lower significantly when the frequency is set lower than 600 Hz. In contrast, the present embodiment can provide an output of substantially a constant level even if the frequency is lowered down to 400 kHz. In other words, it is appreciated that the lowest resonance frequency is lowered in the present embodiment as compared to the comparative example.

Particularly in the high frequency range and low frequency range, the output according to the present embodiment was larger than the output in the comparative example. In other words, it is appreciated that sound pressure is increased in the present embodiment as compared to the comparative example.

Figure 12:
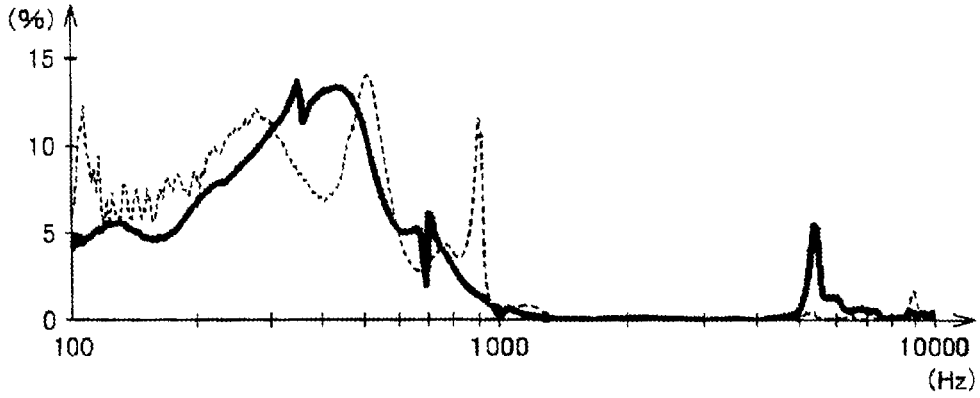
FIG. 12 is a graph schematically representing the frequency characteristic of the distortion component in each of the first embodiment of the present invention and a comparative example.

Referring to FIG. 12, in the present embodiment indicated by a solid line as compared to the comparative example indicated by a broken line, the distortion defined by the sum of the total high frequency distortion and noise (THD+N (Total Distortion Plus Noise)) has become smaller particularly at the region where the frequency range is equal to or less than 300 Hz. Furthermore, the distortion peak in the vicinity of 900 Hz, encountered in the comparative example, is absent in the present embodiment. Thus, it is appreciated that the distortion has become smaller in the present embodiment as compared to the comparative example.

Although the speaker unit according to the first embodiment is an outer core type, the present invention is not limited thereto, and may be an inner core type.

In other words, a magnet may be arranged at the inner circumferential side of the coil, spaced apart therefrom.

Second Embodiment

Figure 13:
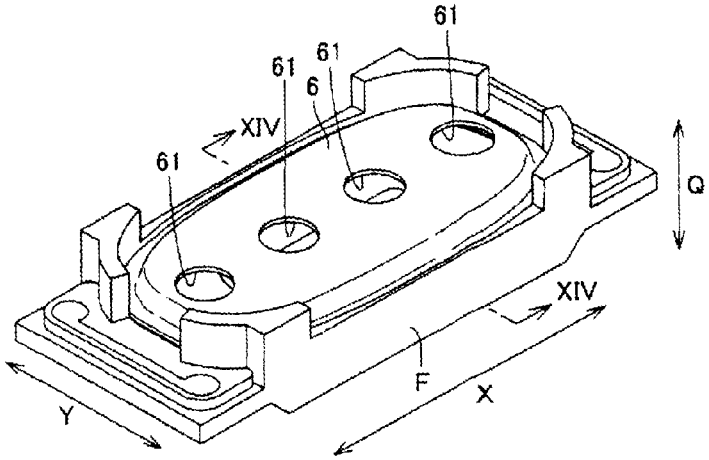
FIG. 13 is a schematic perspective view of a configuration of a speaker unit according to a second embodiment of the present invention.
Figure 14:
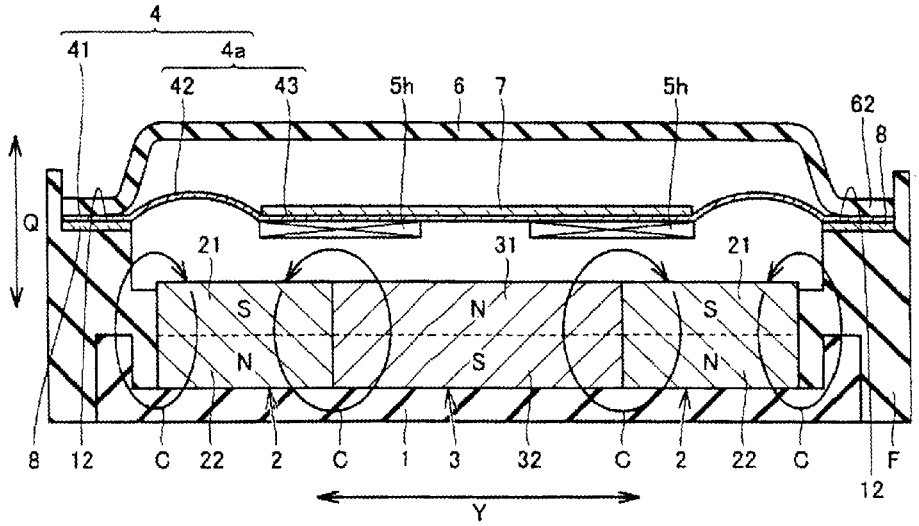
FIG. 14 is a schematic sectional view taken along line XIV-XIV of FIG. 13.

Referring to FIGS. 13 and 14, a speaker unit according to the present embodiment includes a coil 5*h*, a frame F, a bottom plate 1, an outer magnet 2, and an inner magnet 3.

Frame F and bottom plate 1 (FIG. 14) constitute an elongated box-like shape. Each of the two outer magnets 2 and one inner magnet 3 extends in the major axis direction X on bottom plate 1 with a predetermined distance from diaphragm 4. Inner magnet 3 is disposed between two outer magnets 2. An upper portion 21 and a lower portion 22 of outer magnet 2 correspond to the S pole and N pole, respectively, whereas an upper portion 31 and a lower portion 32 of inner magnet 3 correspond to the N pole and S pole, respectively. Bottom plate 1 is formed of a ferromagnetic member. By this configuration, the magnetic flux generated by outer magnet 2 and inner magnet 3 form the loop indicated by arrow C in FIG. 2.

Coil 5*h* is formed of a wire wound about an axis parallel to vibrating direction Q (FIG. 14), having a flattened shape. Since the direction of the magnetic field is along the minor axis direction Y in the vicinity of coil 5*h*, diaphragm 4 can be made to vibrate in a direction (vibrating direction Q) orthogonal to the direction of current (major axis direction X) and the direction of magnetic field (minor axis direction Y) by conducting a current flow to coil 5*h*.

The remaining configuration is substantially identical to that of the first embodiment set forth above. The same or corresponding elements have the same reference characters allotted, and description thereof will not be repeated.

Advantages similar to those of the first embodiment can be achieved by the present embodiment.

Third Embodiment

Figure 15:
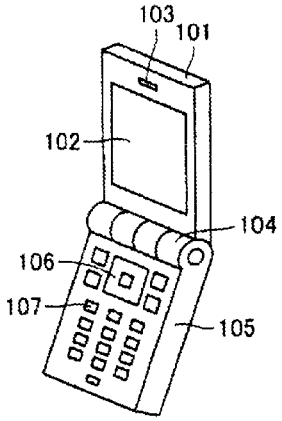
FIG. 15 is a schematic partial perspective view of a configuration corresponding to the operation face side of a portable information terminal according to a third embodiment of the present invention.
Figure 16:
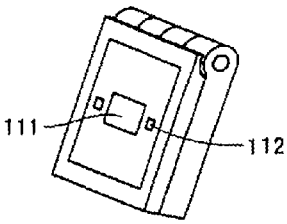
FIG. 16 is a schematic partial perspective view of a configuration corresponding to the backside of the portable information terminal of FIG. 15.

Referring to FIGS. 15 and 16, a portable information terminal according to the present embodiment is a mobile phone, including an upper case 101, a display 102, a sound out hole 103, a hinge 104, a lower case 105, an operation button 106, a numeric button 107, a display 111, a sound out hole 112, and a plurality of speaker units (not shown in FIGS. 15 and 16).

One speaker unit is incorporated in the vicinity of sound out hole 103 as a receiver that generates receiving sound. Moreover, another speaker unit is incorporated in the vicinity of sound out hole 112 as a speaker that generates a ringing tone or the like. These speaker units have the configuration of the first embodiment or second embodiment set forth above.

Since the speaker unit according to the present embodiment can be mounted in a more restricted space, the portable information terminal can be reduced in size, thickness, or weight.

It should be understood that the embodiments disclosed herein are illustrative and non-restrictive in every respect. The scope of the present invention is defined by the terms of the claims, rather than the description of the embodiments set forth above, and is intended to include any modifications within the scope and meaning equivalent to the terms of the claims.

INDUSTRIAL APPLICABILITY

The present invention is particularly advantageously applicable to a speaker unit including a diaphragm to which a coil is attached.

REFERENCE SIGNS LIST

4 diaphragm; 4*a*, 4*av* diaphragm piece; 5, 5*h* coil; 7 reinforcement sheet; 8 reinforcement ring; 41 outer frame portion; 42 edge portion; 42*a* edge outer circumference; 43*a* trunk portion outer circumference; 43 trunk portion; 48 crimp; 81, 85 adhesive portion; A1 major axis; A2 minor axis; CB trunk curve section; CE edge curve section; F frame; Fv base frame; LB1 trunk straight section; LB2 trunk straight section; LE1 edge straight section; LE2 edge straight section; O intersection point (center); Q vibrating direction; X major axis direction; Y minor axis direction.

The invention claimed is:

1. A speaker unit comprising:

a coil;

a diaphragm including a trunk portion to which a coil is attached, and an edge portion surrounding an outer circumference of said trunk portion in plan view; and a reinforcement sheet attached to said trunk portion, wherein an outer circumference of said edge portion includes first and second edge straight sections extending linearly in a major axis direction and a minor axis direction of said edge portion, respectively, and an edge curve section joining said first and second edge straight sections together, wherein said diaphragm includes a plurality of crimps in a region of said edge portion located between phantom straight lines extending from the center of said trunk portion to either end of said edge curve section, wherein all of said plurality of crimps extend radially about said center of said trunk portion, and wherein each of said trunk portion of said diaphragm and said reinforcement sheet is transparent relative to light having a wavelength in a visible light region.

2. The speaker unit according to claim 1, wherein said reinforcement sheet is attached to said trunk portion by an adhesive that allows transmission of visible light.

3. The speaker unit according to claim 1, wherein said edge curve section has a shape represented by one of a quadratic curve and cubic curve.

4. A portable information terminal, comprising a speaker unit defined in claim 1.

5. A speaker unit comprising:

a coil;

a diaphragm including a trunk portion to which a coil is attached, and an edge portion surrounding an outer circumference of said trunk portion in plan view; and a reinforcement sheet attached to said trunk portion, wherein an outer circumference of said edge portion includes first and second edge straight sections extending linearly in a major axis direction and a minor axis direction of said edge portion, respectively, and an edge curve section joining said first and second edge straight sections together, wherein said diaphragm includes a plurality of crimps in a region of said edge portion located between phantom straight lines extending from the center of said trunk portion to either end of said edge curve section, wherein all of said plurality of crimps extend radially about said center of said trunk portion, and wherein said diaphragm includes an outer frame portion surrounding said edge portion in plan view, and that is transparent to light having a wavelength in a visible light region, further comprising a reinforcement ring attached on said outer frame portion, and that allows transmission of visible light.

6. The speaker unit according to claim 5, wherein said reinforcement ring is attached to said outer frame portion by an adhesive that allows transmission of visible light.

* * * * *